US008530026B2

(12) United States Patent
Spaans et al.

(10) Patent No.: US 8,530,026 B2
(45) Date of Patent: Sep. 10, 2013

(54) ARTIFICIAL FIBER FOR USE IN AN ARTIFICIAL GRASS SPORTS FIELD

(75) Inventors: Pieter Spaans, Nijverdal (NL); Paulus Ignatius Van Leur, Nijmegen (NL); Geurt Bastiaan Slootweg, Enschede (NL); Frederik Jan Van der Gaag, Nijverdal (NL)

(73) Assignee: Ten Cate Thiolon B.V. (NL)

( * ) Notice: Subject to any disclaimer, the term of this patent is extended or adjusted under 35 U.S.C. 154(b) by 0 days.

(21) Appl. No.: 13/402,063

(22) Filed: Feb. 22, 2012

(65) Prior Publication Data

US 2012/0156401 A1 Jun. 21, 2012

Related U.S. Application Data

(63) Continuation of application No. 11/883,434, filed as application No. PCT/NL2006/000057 on Feb. 3, 2006, now abandoned.

(30) Foreign Application Priority Data

Feb. 8, 2005 (NL) ..... 1028224

(51) Int. Cl.
*E01C 13/08* (2006.01)

(52) U.S. Cl.
USPC ..... 428/92; 428/17; 428/397

(58) Field of Classification Search
USPC ..... 428/17, 92, 97, 397
See application file for complete search history.

(56) References Cited

U.S. PATENT DOCUMENTS

| | | | |
|---|---|---|---|
| 3,549,724 | A | 12/1970 | Okazaki et al. |
| 3,565,742 | A | 2/1971 | Stephens et al. |
| 3,837,980 | A | 9/1974 | Nishimura et al. |
| 3,940,522 | A | 2/1976 | Wessells |
| 4,044,179 | A | 8/1977 | Haas, Jr. et al. |
| 4,176,150 | A | 11/1979 | Bromley et al. |
| 4,337,283 | A | 6/1982 | Haas, Jr. et al. |
| 4,416,934 | A | 11/1983 | Kimura et al. |
| 4,559,268 | A | 12/1985 | Nakashima et al. |
| 5,006,057 | A | 4/1991 | Bagrodia et al. |
| 5,334,452 | A | 8/1994 | Yu |
| 5,364,692 | A | 11/1994 | Bowen et al. |
| 5,447,771 | A | 9/1995 | Mills et al. |
| 5,462,778 | A | 10/1995 | Ishikawa |
| 5,486,417 | A | 1/1996 | Hagen et al. |
| 5,904,982 | A | 5/1999 | Kent et al. |

(Continued)

FOREIGN PATENT DOCUMENTS

| | | |
|---|---|---|
| EP | 0259940 | 3/1988 |
| EP | 0432272 | 6/1991 |

(Continued)

*Primary Examiner* — Cheryl Juska
(74) *Attorney, Agent, or Firm* — Olson & Cepuritis, Ltd.

(57) ABSTRACT

An artificial fiber for use in an artificial grass sports field is disclosed wherein, seen in a transverse sectional direction of the fiber, at least part of the fiber is provided with a stiffness-enhancing portion extending in the longitudinal direction thereof. The artificial fiber includes at least two fiber flange portions, at least one fiber flange portion forming the stiffness-enhancing portion, while at least two fiber flange portions have a uniform thickness. The improved artificial fiber is less flexible and consequently exhibits less tendency to deform to a flat orientation, but does not increase the risk of injuries to players or have an adverse effect on the playing characteristics of the field. Also disclosed is an artificial grass lawn, suitable for sports fields, having a substrate to which one or more artificial fibers of the invention are attached.

13 Claims, 4 Drawing Sheets

(56) References Cited

U.S. PATENT DOCUMENTS

| | | | |
|---|---|---|---|
| 5,922,462 | A | 7/1999 | Kent et al. |
| 5,998,310 | A | 12/1999 | Bowen, Jr. |
| 6,017,478 | A | 1/2000 | Kent et al. |
| 6,432,505 | B1 | 8/2002 | Sweenie et al. |
| 6,815,059 | B2 | 11/2004 | Slootweg et al. |
| 6,841,247 | B2 | 1/2005 | Blackwell et al. |
| 6,955,841 | B2 | 10/2005 | Weghuis et al. |
| 6,958,188 | B2 | 10/2005 | Blackwell et al. |
| 2001/0033902 | A1 | 10/2001 | Seaton |
| 2003/0099787 | A1 | 5/2003 | Fink |
| 2003/0108688 | A1 | 6/2003 | De Vries |
| 2003/0157275 | A1 | 8/2003 | Weghuis et al. |
| 2004/0071963 | A1 | 4/2004 | Boyle et al. |
| 2005/0064112 | A1 | 3/2005 | Nicholls et al. |
| 2005/0238823 | A1 | 10/2005 | Weghuis et al. |
| 2006/0159917 | A1 | 7/2006 | Verleyen |
| 2010/0009100 | A1 | 1/2010 | Van Reijen |

FOREIGN PATENT DOCUMENTS

| | | |
|---|---|---|
| EP | 1158099 | 11/2001 |
| EP | 1386944 | 2/2004 |
| EP | 1389649 | 2/2004 |
| EP | 1376592 | 9/2004 |
| GB | 938768 | 10/1963 |
| WO | WO 02/00973 | 1/2002 |
| WO | WO 03/082965 | 10/2003 |
| WO | WO 2004/041721 | 5/2004 |
| WO | WO 2004/106601 | 12/2004 |
| WO | WO 2005/005730 | 1/2005 |
| WO | WO 2005/047602 | 5/2005 |

ARTIFICIAL FIBER FOR USE IN AN ARTIFICIAL GRASS SPORTS FIELD

CROSS-REFERENCE TO RELATED APPLICATIONS

This application is a continuation of U.S. Ser. No. 11/883,434, filed Mar. 13, 2008 as the National Stage of PCT/NL2006/000057 filed Feb. 3, 2006 claiming the priority of NL1028224, filed Feb. 8, 2005, the entire disclosures of which are incorporated herein by reference.

DESCRIPTION

The invention relates to an artificial fiber of the monofilament-type for use in an artificial grass sports field wherein, seen in a transverse sectional direction of the fiber, at least part of the fiber is provided with stiffness-enhancing portion extending in the longitudinal direction thereof.

The invention also relates to an artificial grass lawn suitable for sports fields, consisting at least of a substrate to which one or more artificial fibers according to the invention are attached.

Many sports, such as field hockey, tennis, American football, etc., are now played on artificial grass sports fields, which sports fields are composed of an artificial grass lawn on which artificial fibers are provided. Although athletes sustain fewer injuries on a natural grass sports field when falling or making a sliding tackle, on account of the softer surface thereof, such sports fields are often severely damaged when the above sports are played thereon, precisely because they are used intensively and because of the varying influence of the weather conditions.

A drawback of the artificial fibers that are currently known is that they attend to assume a flat orientation relative to the ground surface after being played on. This results in so-called "bare patches" in the artificial grass sports field and thus in an increased risk of injuries, etc.

This problem can be eliminated in part, for example, by providing a granular infill material such as sand or granules of a plastic material between the artificial fibers. The presence of these infill granules leads to a more upright orientation of the artificial grass fibers. In addition, the infilled grains provide a softer, shock-absorbing playing surface on which players are less prone to injury. Furthermore, they provide improved playing characteristics, so that the playing characteristics of artificial grass sports fields resemble those of natural grass sports fields as much as possible.

The use of an infill in artificial grass sports fields, however, has a number of drawbacks. Not only is the construction of such an artificial grass sports field more labor-intensive than the construction of a natural grass sports field, but an artificial grass sports field provided with an infill requires subsequent maintenance as well. The initially uniform distribution of the granular infill can be disturbed by intensive usage. As a result, areas containing hardly any infill may form in places where the field is played on very intensively, for example, in the goal area. This has an adverse effect on the quality of play, which can lead to an increased risk of injury.

Another solution to the problem as described above is to increase the stiffness of the monofilament by changing the chemical composition and/or the processing method thereof. This is undesirable, however, because it will lead to a more abrasive artificial grass sports field with an increased risk of injuries.

A further solution to the problem as described above is to adapt the geometry of the artificial fiber, for example, as proposed in U.S. 2001/033902 or in WO 2005/005730. Both patent documents disclose fibers provided with stiffness-enhancing means. However, on account of the geometry of the fiber and the location of the stiffness-enhancing means, the artificial fibers that are obtained exhibit an increased risk of splitting and/or fracture as a result of material stresses that may be set up in the fiber, for example, due to loads exerted thereon during play or temperature changes that may occur.

It is also noted in this connection that U.S. 2001/033902 discloses a composite filament fiber (also called multifilament) which, on account of the geometry and the orientation of the stiffness-enhancing means, specifically provides weak lines of fracture in the composite fiber. The fiber is required to split in that case to create multiple filament fibers.

Similar weak artificial fibers that are liable to split and/or fracture are disclosed in WO 2005/005730. That publication also discloses a fiber comprising stiffness-enhancing means, but the fiber, on account of its geometry, has undesirable points or lines of fracture at which undesirable material stresses may be set up, for example, due to loads being exerted thereon during play (sliding tackles, etc.) or temperature changes that may occur.

It is one object of the present invention to avoid such a weak artificial fiber that remains susceptible to splitting and fracture, and to provide an improved artificial fiber for use in an artificial grass sports field, which fiber is provided with stiffness-enhancing portion. The fiber is less flexible, on account of the geometry of the fiber, exhibits less tendency to assume a flat orientation or to split or fracture, and furthermore does not exhibit an increased risk of injuries or have an adverse effect on the playing characteristics.

According to the invention, the artificial fiber comprises at least two fiber flange portions, at least one fiber flange portion forming the stiffness-enhancing portion, while at least two fiber flange portions have a uniform thickness.

More specifically, the stiffness-enhancing portion extends the full length of the fiber. On the other hand, the stiffness-enhancing portion can extend at least partially in the transverse sectional direction.

In another embodiment, the stiffness-enhancing portion is configured as at least one fiber flange portion extending at an angle to the plane formed by the fiber. The at least one fiber flange portion extends at an angle of about 90 degrees or about 45 degrees to the plane formed by the fiber in that embodiment.

In other embodiments, the at least one fiber flange portion is straight, curved or spiral-shaped.

BRIEF DESCRIPTION OF THE DRAWINGS

The invention will now be explained in more detail with reference to the drawings, in which.

DETAILED DESCRIPTION OF PREFERRED EMBODIMENTS

FIGS. 1-5 are cross-sectional views of artificial fibers according to the invention, in which each fiber 30-70 is provided with stiffness-enhancing portion 33-73 extending in the longitudinal direction of the fiber.

Figure 1:
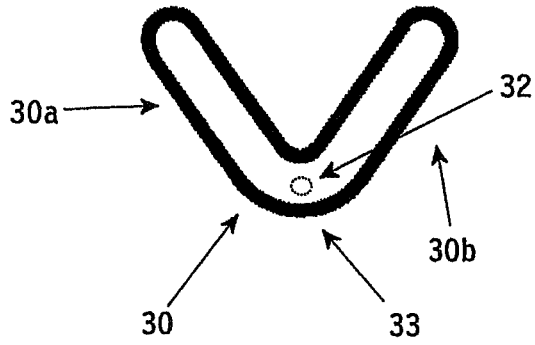
FIGS. 1-5 show various embodiments of an artificial fiber according to the invention.

In the embodiment shown in FIG. 1, the fiber 30 is configured as an extruded band of plastic material having a longitudinal direction 32, which artificial fiber 30 has a V-shaped transverse cross-section made up of two fiber flange portions 30*a* and 30*b*, respectively, which extend in a transverse direction on either side of the longitudinal axis 32. The stiffness-enhancing portion is indicated at 33 in the embodiment shown in FIG. 1 and comprises a curved or rounded portion along the longitudinal axis joining laterally opposed, directionally diverging fiber flange portions 30*a* and 30*b*. The stiffness-enhancing portion resists deformation of the fiber.

Figure 2:
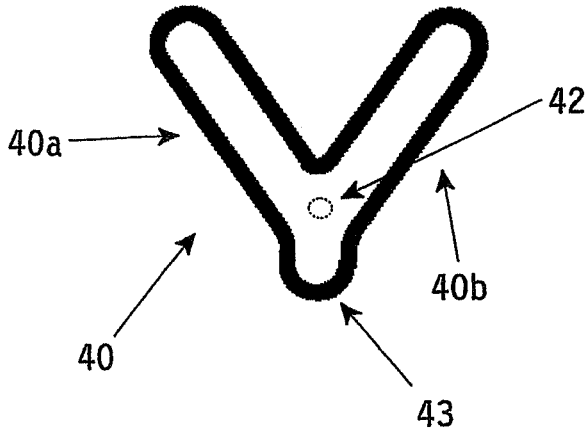

In the embodiment shown in FIG. 2, the stiffness-enhancing portion 43 is configured as at least one fiber flange portion 43 extending at an angle to the plane formed by the artificial fiber 40. In this embodiment, the artificial fiber 40 also has a V-shaped cross-section made up of two fiber flange portions 40*a*-40*b*, which extend symmetrically in a transverse direction with respect to the longitudinal axis 42. The stiffness-enhancing portion 43 is incorporated in the fiber at the location of the longitudinal axis 42.

Figure 3:
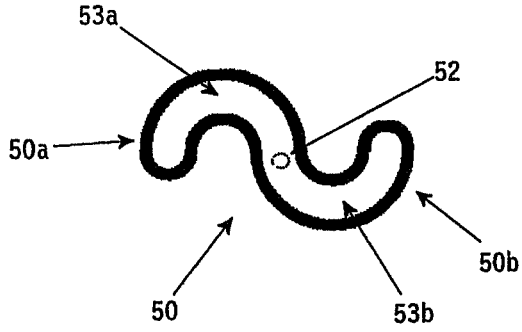

In the embodiment shown in FIG. 3, the fiber 50 includes two fiber flange portions 50*a*-50*b*, which extend symmetrically in a transverse direction with respect to the longitudinal axis 52 and which have a curved shape, which curved shape forms the stiffness-enhancing portions 53*a* and 53*b*, respectively. In this embodiment, the fiber flange portion 50*a*-50*b* is curved, with each fiber flange portion 50*a*-50*b* comprising a curve.

Figure 4:
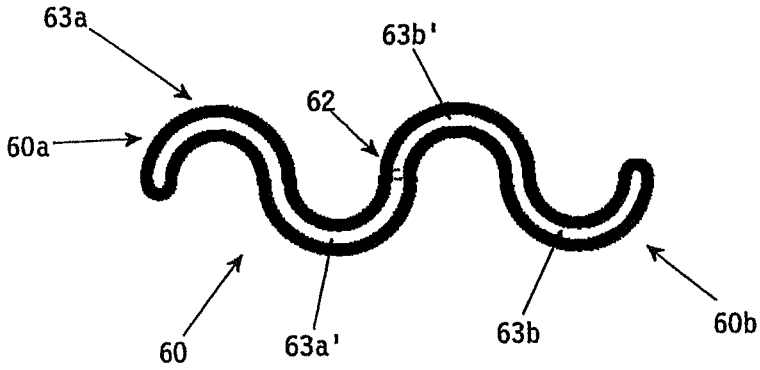

FIG. 4 shows an alternative embodiment of the artificial fiber shown in FIG. 3, in which the artificial fiber 60 is provided with fiber flange portions 60*a*-60*b* exhibiting multiple curves (two in this embodiment). Each fiber flange portion 60*a*-60*b* exhibits two curves 63*a*-63*a*' and 63*b*-63*b*', respectively, which form the stiffness-enhancing portion.

Figure 5:
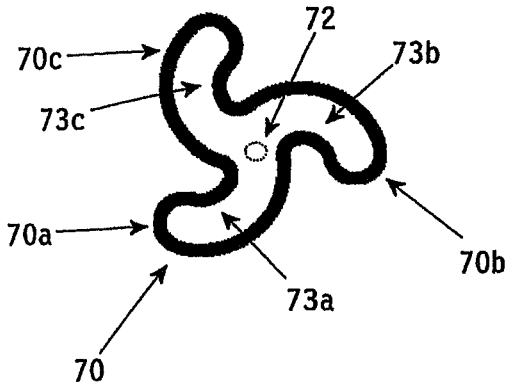

In the embodiment shown in FIG. 5, the artificial fiber 70 comprises three fiber flange portions 70*a*-70*c*, which extend in a star-shaped manner with respect to the longitudinal axis 72. It will be apparent that more than three fiber flange portions extending symmetrically with respect to the longitudinal axis 72 may be used in this embodiment. In addition, each fiber flange portion 70*a*-70*c* in this embodiment comprises a curve, which curves form in the stiffness-enhancing portions 73*a*-73*c*.

While the fiber flange portions 70*a*-70*c* extend in a star-shaped, albeit curved, manner with respect to the longitudinal axis 72 in FIG. 5, the flange portions 70*a*-70*c* of the fiber 70 of another embodiment (not shown) may be straight. The fiber flange portions 70*a*-70*c* (the legs) may be identical in length in that embodiment, while in another embodiment the legs may be different in length, similar to the embodiment shown in FIG. 2.

It is noted that the artificial fiber shown in FIGS. 1-5 is configured as a monofilament fiber obtained by means of an extrusion process. In view of the geometries as shown in FIGS. 1-5, use is made of stiffness-enhancing portions, which preferably extend in the longitudinal direction of the fiber and which may optionally extend in the transverse direction of the fiber. As a result, the fiber is less flexible, and thus will exhibit less tendency to assume a flat orientation in the artificial grass sports field.

In spite of the use of less flexible artificial fibers that, according to the invention, include stiffness-enhancing portions incorporated in the fiber, it has become apparent that the risk of injuries does not significantly increase and furthermore that the playing characteristics of an artificial grass sports field comprising such artificial fibers 10-100 are not adversely affected.

It is also pointed out that the embodiments shown in FIGS. 1-5 provide a possibility of absorbing or retaining water, which has a positive effect on the playing characteristics of the field.

In addition, the fiber flange portions 30*a*-30*b*; 40*a*-40*b*; 50*a*-50*b*; 60*a*-60*b* and 70*a*-70*b* in FIGS. 1-5 each have a uniform thickness. Thus, no material stresses that might lead to undesirable deformation occur in the fiber material. Moreover, the uniform thickness significantly adds to the life of the fiber, as wear is prevented.

Figure 6:
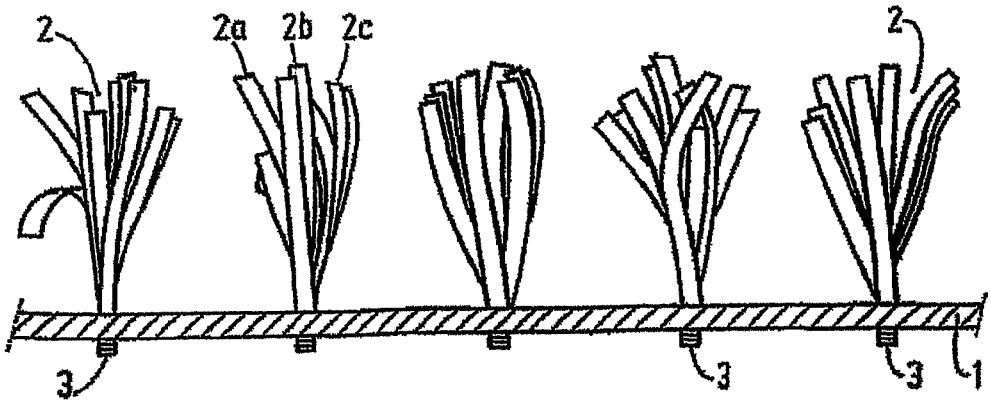
FIGS. 6 and 7 schematically show a few embodiments of an artificial grass sports field provided with an artificial fiber according to the invention.
Figure 7:
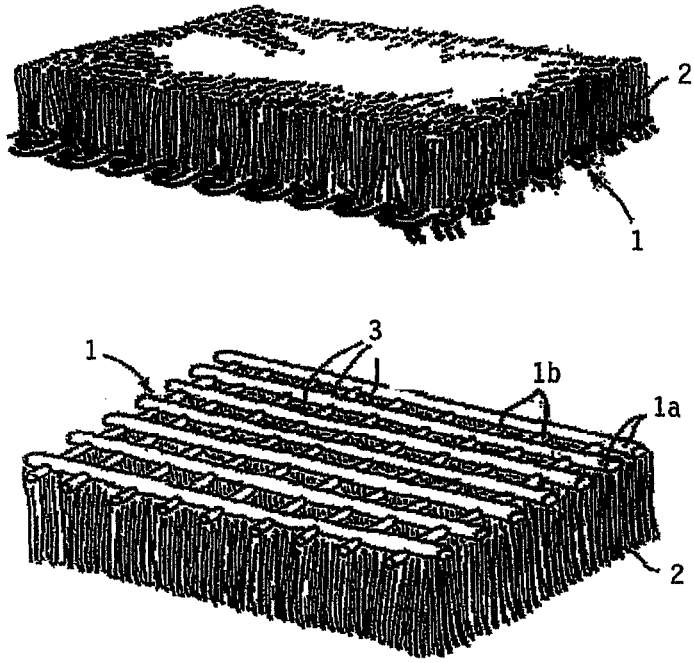

FIGS. 6 and 7 show a few embodiments of an artificial grass sports field in which an artificial fiber according to the invention can be used. In both Figures, the artificial grass sports field comprises a substrate 1, to which several artificial fibers 2 (corresponding to the fibers 30-70 in FIGS. 1-5) are attached at the locations indicated at 3. The extruded artificial fiber may be provided on the substrate either individually or in the form of a bundle of fibers 2*a*-2*c*, which are twined together, for example.

In another embodiment, as shown in FIG. 7, the artificial fiber according to the invention may be a monofilament. In this embodiment, several monofilaments may also be combined into bundles by twining, after which each bundle is attached to the substrate 1. The substrate shown in FIG. 7 has an open structure, being composed of a grid of supporting yarns 1*a*-1*b*, on which the artificial fibers 2 are provided.

The foregoing description and the accompanying drawings are illustrative of the present invention. Other variations and arrangements are possible without departing from the spirit and scope of the invention.

What is claimed is:

1. An artificial grass sports field comprising a backing to which a plurality of artificial grass fibers are attached, positioned in a substantially upright orientation, said fibers comprising an elongated monofilament defining a longitudinal axis and including at least two fiber flange portions having a uniform thickness, wherein at least one of the fiber flange portions includes a stiffness-enhancing portion along at least a section of the longitudinal axis, where in comparison to an artificial grass fiber not having said stiffness-enhancing portion, the stiffness-enhancing portion increases the resistance of said artificial grass fiber to deformation from said substantially upright orientation in said artificial grass sports field, prior to being played upon by a player, to a substantially flat orientation in said artificial grass sports field, when a load is applied thereto by said player during sport use, the stiffness-enhancing portion extending at least partially in a transverse direction relative to the longitudinal axis of a fiber and the at least two flange portions extending symmetrically from the fiber in a transverse direction relative to the longitudinal axis thereof.

2. The artificial grass sports field according to claim 1, wherein each fiber flange portion has a uniform thickness for extending the life of the fiber during sports use.

3. The artificial grass sports field according to claim 1, wherein the stiffness-enhancing portion extends the full length of the fiber.

4. The artificial grass sports field according to claim 1, wherein the fiber includes a star-shaped section comprising at least three fiber flange portions.

5. The artificial grass sports field according to claim 4, wherein each fiber flange portion has a uniform thickness.

6. The artificial grass sports field according to claim 4, wherein each fiber flange portion has a uniform length.

7. The artificial grass sports field according to claim 1, wherein the stiffness-enhancing portion positions at least one fiber flange portion at an angle relative to another fiber flange portion.

8. The artificial grass sports field according to claim 7, wherein the angle is between about 45 degrees to about 90 degrees.

9. The artificial grass sports field according to claim 8, wherein the angle is about 45 degrees.

10. The artificial grass sports field according to claim 8, wherein the angle is about 90 degrees.

11. The artificial grass sports field according to claim 1, wherein at least one fiber flange portion is substantially planar.

12. The artificial grass sports field according to claim 1, wherein at least one fiber flange portion is curved.

13. The artificial grass sports field according to claim 1, wherein at least one fiber flange portion is spiral-shaped.

* * * * *